US007263991B2

(12) United States Patent
Schlosser et al.

(10) Patent No.: US 7,263,991 B2
(45) Date of Patent: Sep. 4, 2007

(54) OUTDOOR GAS FIREPLACE

(75) Inventors: Erich J. Schlosser, Barrington, IL (US); Adrian A. Bruno, Rolling Meadows, IL (US); Todd Trein, Bolingbrook, IL (US)

(73) Assignee: Weber-Stephen Products Co., Palatine, IL (US)

( * ) Notice: Subject to any disclaimer, the term of this patent is extended or adjusted under 35 U.S.C. 154(b) by 0 days.

(21) Appl. No.: 10/801,360

(22) Filed: Mar. 16, 2004

(65) Prior Publication Data

US 2004/0231659 A1 Nov. 25, 2004

Related U.S. Application Data

(63) Continuation-in-part of application No. 10/262,140, filed on Oct. 1, 2002, now Pat. No. 6,736,132.

(51) Int. Cl.
*F24B 1/18* (2006.01)
*F24B 1/192* (2006.01)

(52) U.S. Cl. ..... 126/512; 126/544; 126/547

(58) Field of Classification Search ..... 431/125, 431/126, 88; 126/512, 92 R, 503, 92 AC, 126/544, 545, 546, 547; 280/47.131, 47.23, 280/47.24

See application file for complete search history.

(56) References Cited

U.S. PATENT DOCUMENTS 1,224,157 A 5/1917 Fry
1,735,151 A 11/1929 Blaskewitz et al.
3,494,349 A 2/1970 Allen
3,606,371 A * 9/1971 Rousseau ..... 280/47.24
3,742,189 A 6/1973 Conroy et al.
3,805,762 A 4/1974 Nelson
3,863,945 A * 2/1975 Dunstan ..... 280/35
3,865,392 A * 2/1975 Hartway ..... 280/35
3,871,355 A 3/1975 Henry
4,233,890 A 11/1980 Jansen
4,245,505 A 1/1981 Baynes
4,485,972 A 12/1984 Freber
D293,191 S 12/1987 Stephen et al.
4,924,846 A 5/1990 Peacock et al.
5,076,257 A 12/1991 Raymer et al.
5,094,223 A 3/1992 Gonzalez
5,127,824 A 7/1992 Barker
5,399,084 A * 3/1995 McCullough et al. ..... 431/125
5,482,303 A * 1/1996 Meloy ..... 280/43.17
5,598,834 A 2/1997 Grady
5,601,073 A * 2/1997 Shimek ..... 126/512
5,645,043 A 7/1997 Long et al.

(Continued)

OTHER PUBLICATIONS

Instructional annual for Coleman Gas Log Patio Hearth, Model 5076 Series, The Coleman Company, Inc., 2001, pp. 1-8.

(Continued)

*Primary Examiner*—Alfred Basichas
(74) *Attorney, Agent, or Firm*—David I. Roche; Daniel A. Tallitsch; Baker & McKenzie LLP

(57) ABSTRACT

A portable outdoor fireplace is provided. The portable outdoor fireplace has a housing that supports a gas burner. The outdoor fireplace also has removable side panels to expose the burner.

16 Claims, 17 Drawing Sheets

U.S. PATENT DOCUMENTS 5,738,084 A * 4/1998 Hussong ..... 126/512
5,836,298 A 11/1998 Grady
5,848,585 A 12/1998 Long et al.
5,931,154 A * 8/1999 Hussong et al. ..... 126/512
5,960,782 A 10/1999 Clements et al.
5,960,788 A 10/1999 Bach et al.
D420,115 S 2/2000 Bach et al.
6,044,836 A 4/2000 Oliver et al.
6,065,467 A 5/2000 Martin
6,102,029 A 8/2000 Stephen et al.
6,142,143 A * 11/2000 Martin ..... 126/506
6,220,240 B1 4/2001 Grady et al.
6,267,113 B1 * 7/2001 Maust et al. ..... 126/512
6,283,114 B1 9/2001 Giebel et al.
6,286,503 B1 9/2001 Bach et al.
6,354,288 B1 3/2002 McDonald
6,354,831 B1 * 3/2002 Wilk et al. ..... 431/328
6,361,057 B1 * 3/2002 Carter ..... 280/63
D455,206 S 4/2002 Davis et al.
6,385,881 B1 5/2002 Hess
6,439,225 B2 8/2002 Bach et al.
6,488,025 B1 12/2002 Cunningham
6,640,803 B2 * 11/2003 Davis et al. ..... 126/519
D498,523 S * 11/2004 Davis ..... D23/332
2001/0032642 A1 10/2001 Bach et al.

OTHER PUBLICATIONS

Variety of outdoor fireplaces; published at least as early as Mar. 15, 2004; 2 pages.
Gas Fireplace; published at least as early as Mar. 15, 2004; 1 sheet.

* cited by examiner

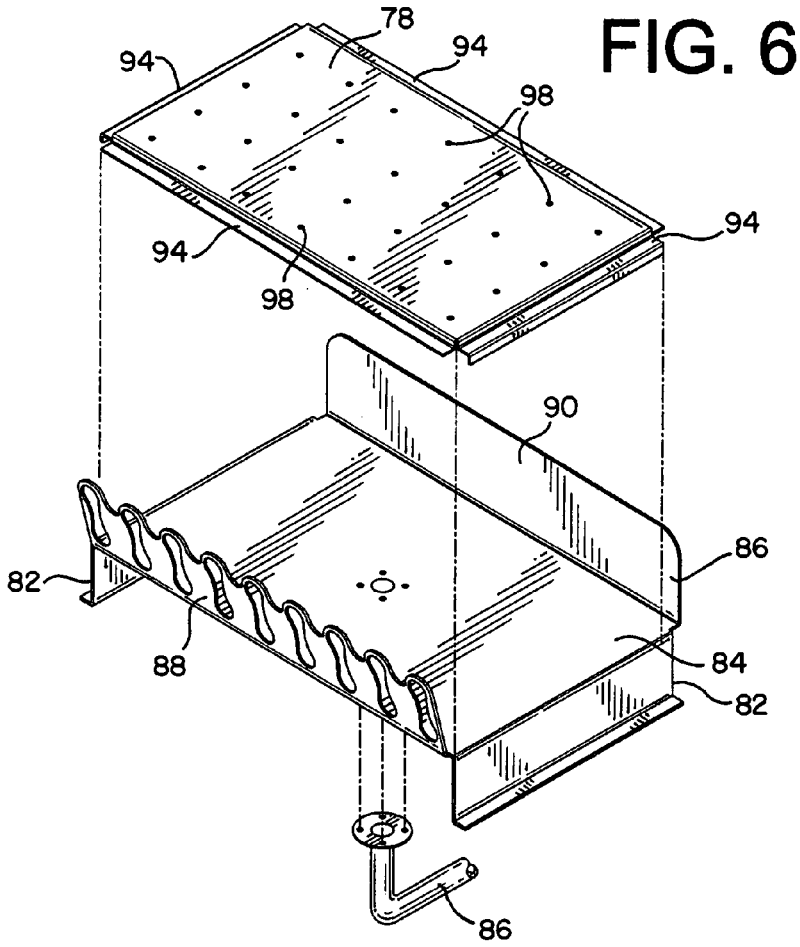
FIG. 6
FIG. 7
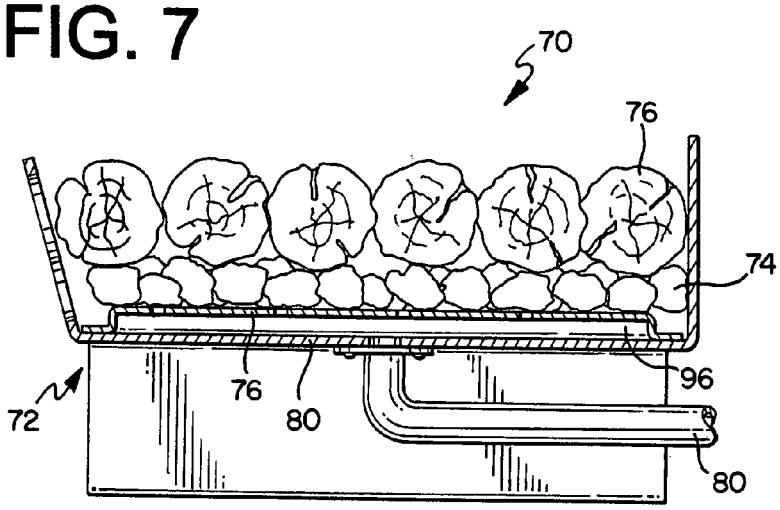

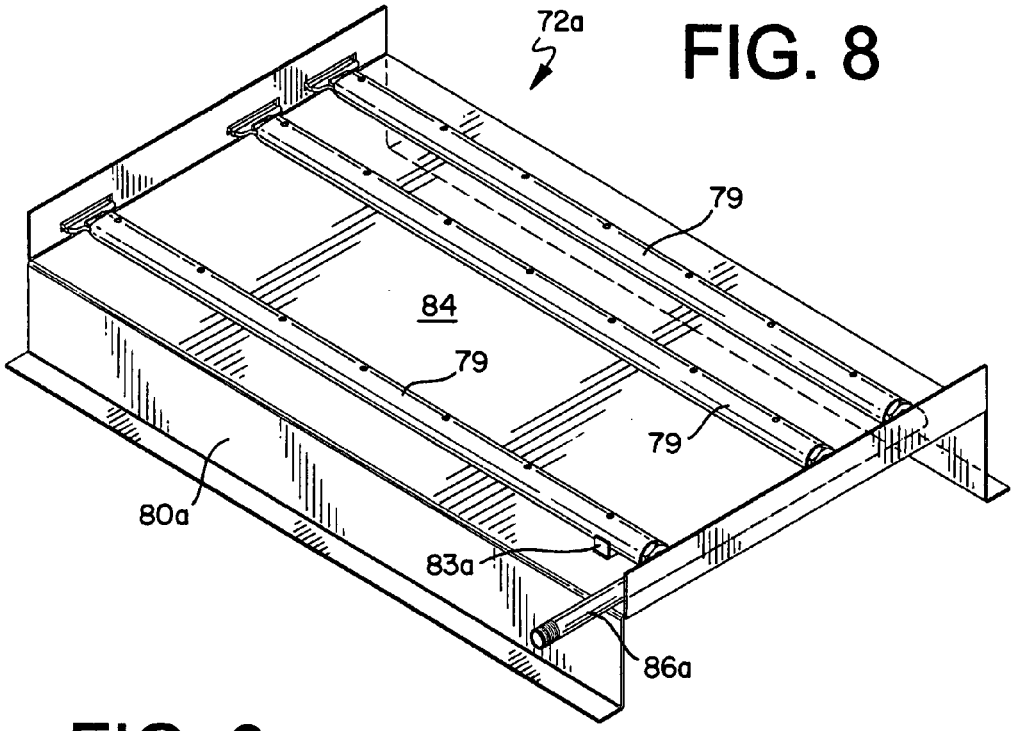
FIG. 8
FIG. 9
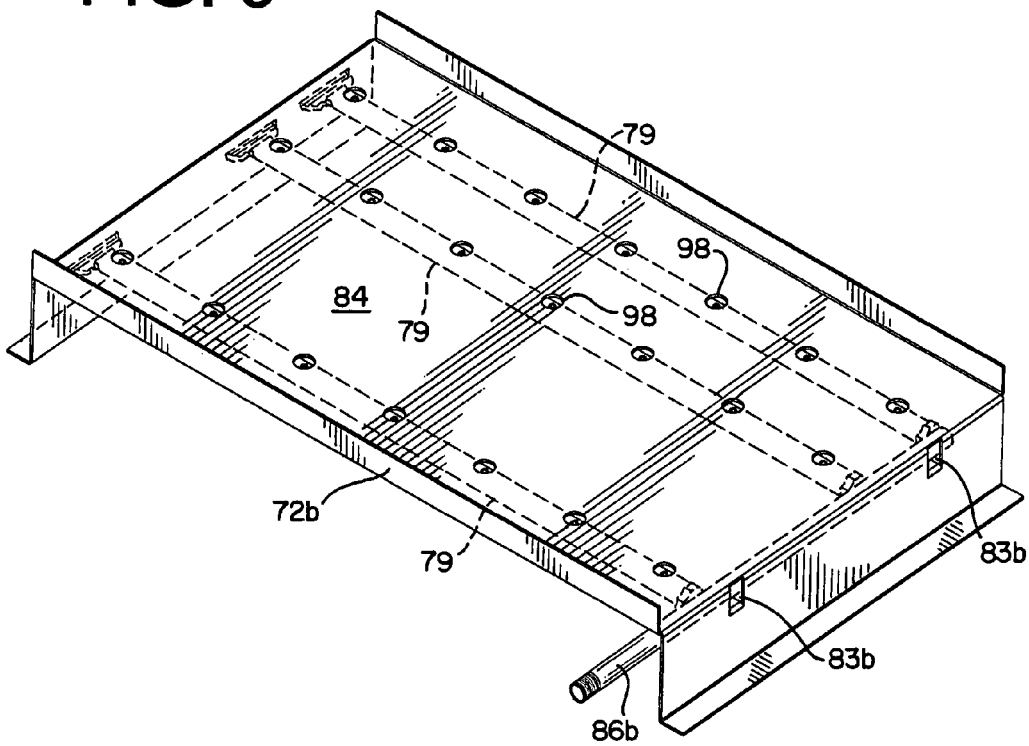

OUTDOOR GAS FIREPLACE

CROSS-REFERENCE TO RELATED APPLICATIONS

The present application is a continuation-in-part of application Ser. No. 10/262,140, filed on Oct. 1, 2002, now U.S. Pat. No. 6,736,132 which is expressly incorporated herein by reference and made a part hereof.

FEDERALLY SPONSORED RESEARCH OR DEVELOPMENT

Not Applicable.

TECHNICAL FIELD

The present invention relates generally to the field of gas-fueled fireplaces, and more specifically to the field of portable gas-fueled outdoor fireplaces.

BACKGROUND OF THE INVENTION

Outdoor fireplaces are well-known in the art, and are generally used to provide outdoor heat and/or to provide an aesthetically appealing appearance of a wood fireplace. Various prior art outdoor fireplaces are illustrated, for example, in U.S. Pat. Nos. 5,598,843; 5,863,294; 5,848,585; 5,094,223; and, D 293,191.

While the outdoor fireplaces of the prior art provide a number of advantageous features, they nevertheless have certain limitations. As described herein, the present invention seeks to overcome certain of these limitations and other drawbacks of the prior art, and to provide new features not heretofore available.

SUMMARY OF THE INVENTION

The present invention provides a portable gas-fueled outdoor fireplace.

According to one embodiment, the outdoor fireplace has a fireplace housing, a burner and a plurality of side panels.

According to another embodiment, at least one of the side panels is individually removable from the housing to expose the burner.

According to another embodiment, the burner comprises a burner plate adjacent a burner base member, and a substantially enclosed cavity between the burner base member and the burner plate. The burner plate has a plurality of apertures therein. Fuel enters the substantially enclosed cavity between the burner base member and the burner plate and is dispersed through the apertures in the burner plate.

According to yet another embodiment, a transport member is connected to the housing in a position that a transport plane is a distance above a baseline of the outdoor fireplace.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 6 is an exploded view of the bottom burner of the outdoor fireplace of FIG. 1;

FIG. 7 is a side view of the bottom burner of the outdoor fireplace of FIG. 1;

FIG. 8 is an alternate embodiment of the bottom burner of the outdoor fireplace of FIG. 1;

FIG. 9 is another alternate embodiment of the bottom burner of the outdoor fireplace of FIG. 1;

DETAILED DESCRIPTION OF THE PREFERRED EMBODIMENT

Figure 1:
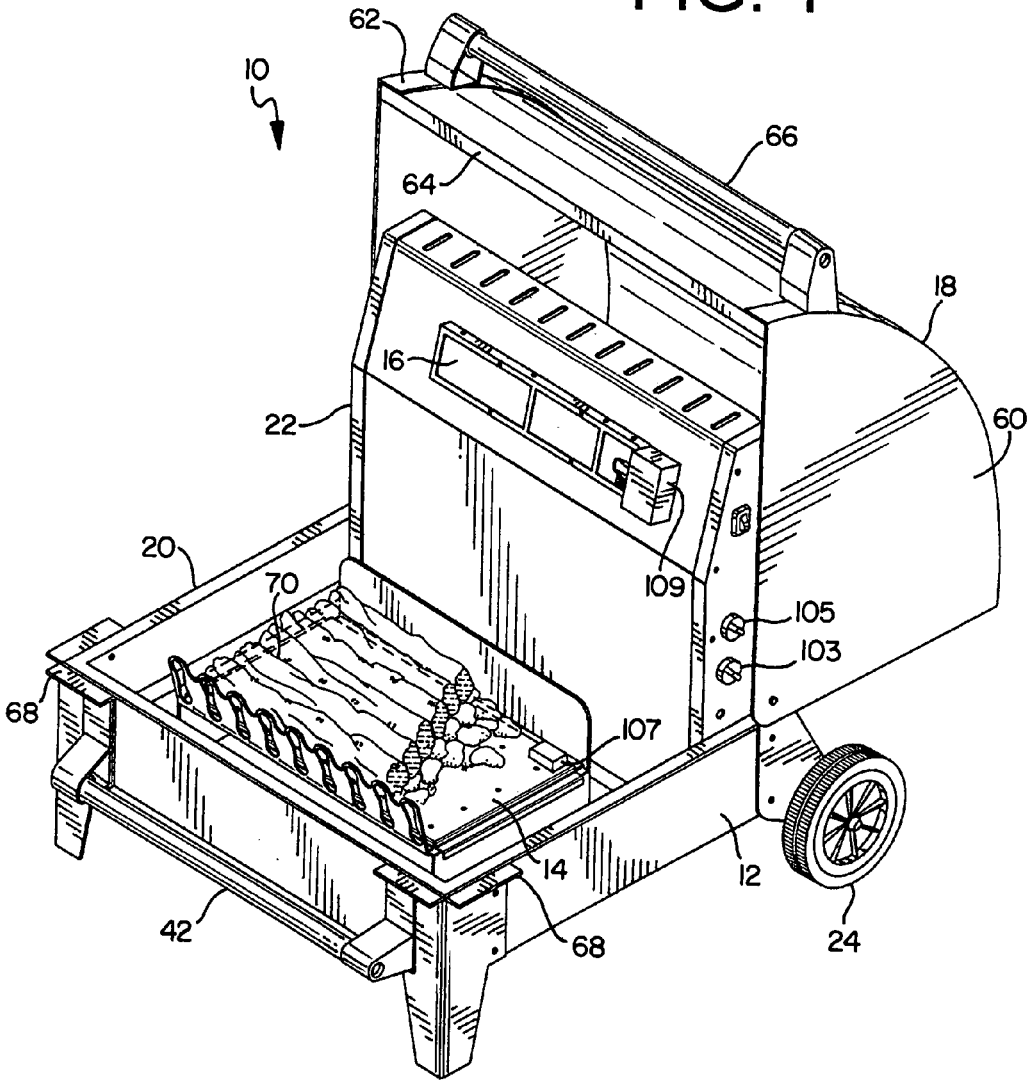
FIG. 1 is a perspective view of the outdoor fireplace.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, and specifically to FIG. 1, there is shown one embodiment of an outdoor fireplace 10. The outdoor fireplace 10 has a fireplace housing 12, a first flame assembly 14 and a second flame assembly 16. A hood 18 depends from the fireplace housing 12. Generally, the fireplace housing 12 supports at least one flame assembly, however, one of ordinary skill in the art would understand that additional flame assemblies may be incorporated into the outdoor fireplace 10 without departing the scope of the invention.

Figure 4:
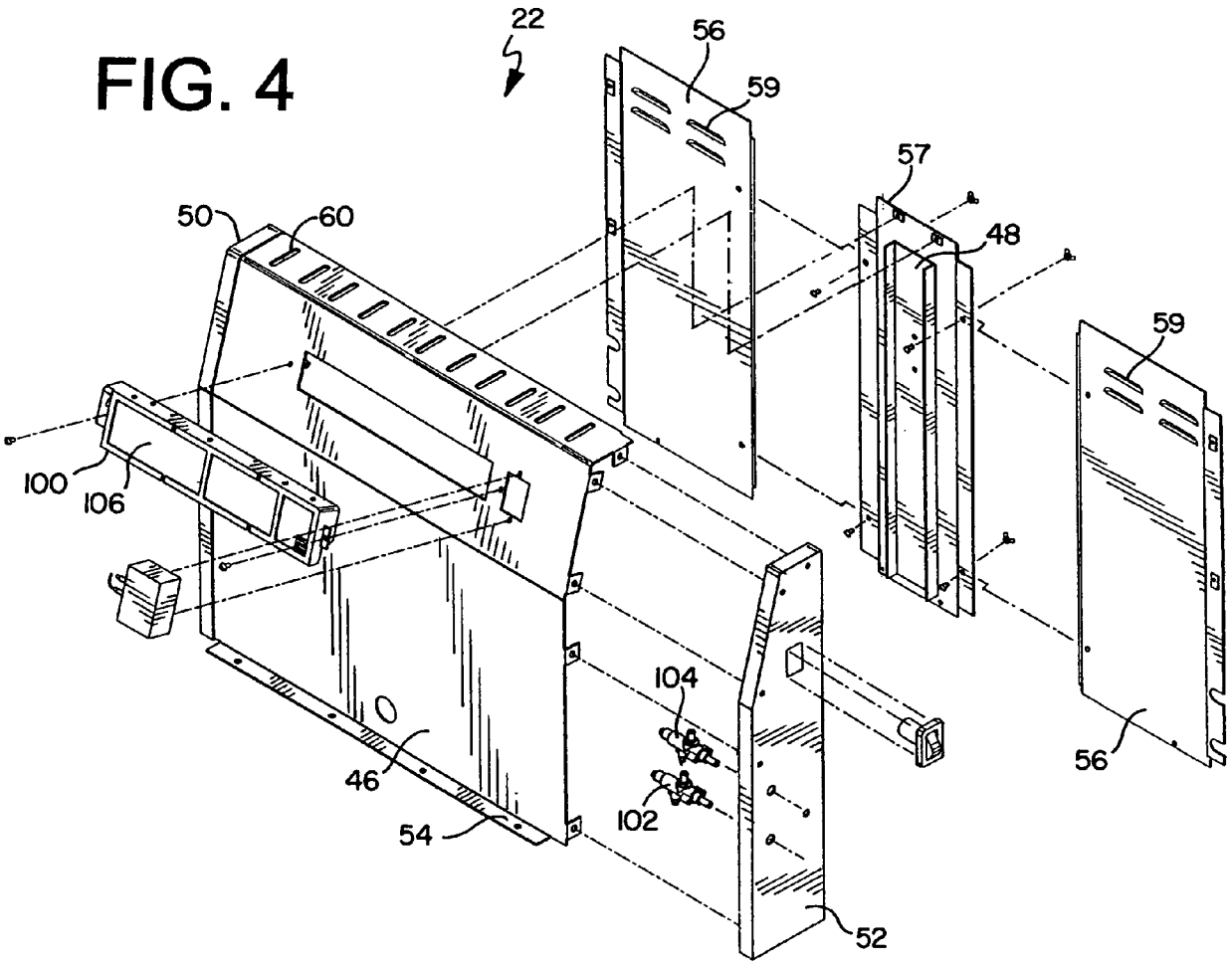
FIG. 4 is an exploded view of the black wall assembly of the outdoor fireplace of FIG. 1.
Figure 5:
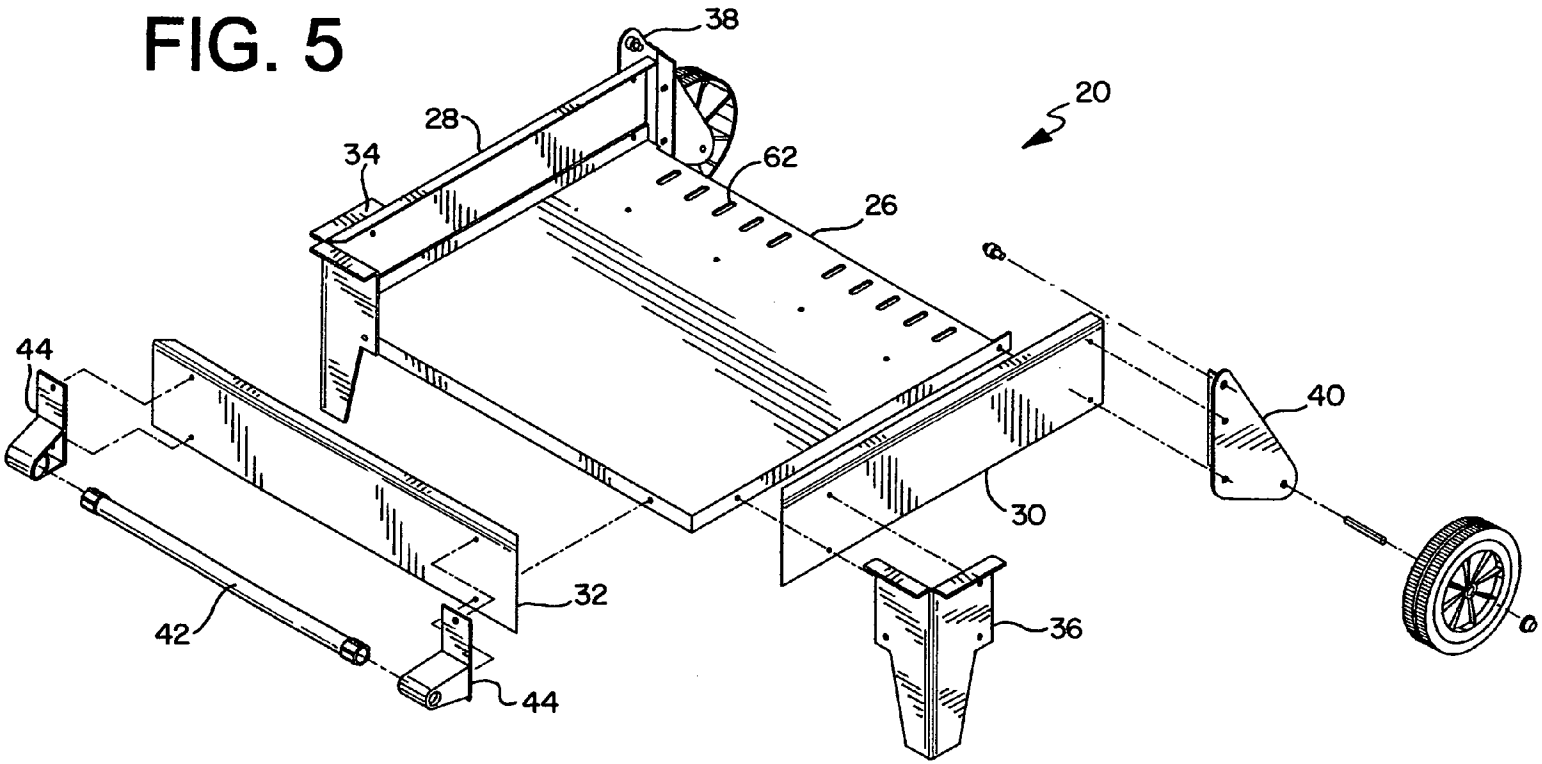
FIG. 5 is an exploded view of the base assembly of the outdoor fireplace of FIG. 1.

As shown in FIGS. 1, 4, and 5, the fireplace housing 12 in one embodiment comprises a first housing member 20 and a second housing member 22. Generally, the first flame assembly 14 is mounted to the first housing member 20, and the second flame assembly 16 is mounted to the second housing member 22. Additionally, a transport member 24 depends from the fireplace housing 12. The transport member 24 supports a portion of the fireplace housing 12, and it also assists in providing portability to the outdoor fireplace 10. In a preferred embodiment, the transport member 24 comprises a wheel.

The first housing member 20 of the outdoor fireplace 10 of the present embodiment functions as a base member. In such an embodiment shown in FIG. 5, the first housing member 20 has a bottom panel 26, opposing first and second side panels 28, 30, a front panel 32, opposing first and second front legs 34, 36 and first and second opposing rear legs 38, 40. During manufacture, the first front leg 34 is secured to the first side panel 28, the front panel 32 and the bottom panel 26 with the use of fasteners. Similarly, the second front leg 36 is secured to the second side panel 30, the front panel 32 and the bottom panel 26 with the use of fasteners. Next, the first rear leg 38 is secured to the first side panel 28 and the bottom panel 26, and the second rear peg leg 40 is secured to the second side panel 30 and the bottom panel 26, with fasteners. In a preferred embodiment, the components of the first housing member 20 are made of sheet material, specifically bent sheet metal, however, one having skill in the art would appreciate that these components may be made and assembled in a variety of ways, including, but not limited to, castings, weldments, forgings, etc. Finally, a handle 42 is mounted to the first housing member 20. In the embodiment illustrated in FIG. 5, the handle is mounted to the first housing member 20 with the use of first and second holders 44 that are fixed to the front legs 34, 36. Additionally, a wheel 24 is rotatedly secured to the first and second rear legs 38, 40, respectively. As such, the outdoor fireplace 10 can be easily moved.

The second housing member 22 (also referred to as a transverse member because of its orientation in various embodiments) of the outdoor fireplace 10 of the present embodiment is positioned transverse to the base member 20, and has a front member 46, a rear member 48 and opposing first and second side members 50, 52. During manufacture, the second housing member 22 is mounted to the first housing member 20. Specifically, the front member 46 is connected to the rear member 48 at a top end of each member. Then, the first side member 50 is secured to one side of the front member 46, and the second side member 52 is secured to the opposing side of the front member 46. Finally, the front member 46 of the second housing member 22 is secured to the bottom panel 26 of the first housing member 20 with fasteners that extend through a lip 54 of the front member 46, the rear member 48 of the second housing member 22 is secured to the bottom panel 26 of the first housing member 20 with fasteners, and the first and second side members 50, 52 are secured to the bottom panel 26 of the first housing member 20 with the use of fasteners. As with the first housing member 30, in a preferred embodiment the components of the second housing member 22 are made of sheet material, specifically bent sheet metal, however, one having skill in the art would appreciate that these components may be made and assembled in a variety of ways, including, but not limited to, castings, weldments, forgings, etc.

The second housing member 22 has a plurality of apertures 60 in the top of the front member 46. Similarly, as shown in FIG. 5, the first housing member 20 has a plurality of apertures 62 in the bottom panel 26. Additionally, the rear member 48 has a plurality of apertures 59. The apertures 59, 60, 62 allow heat to escape out of the internal cavity of the second housing member 22. Further, by having apertures at the top and bottom of the internal cavity of the second housing member 22, a chimney effect is provided to cool down the interior of the second housing member 22.

Figure 3:
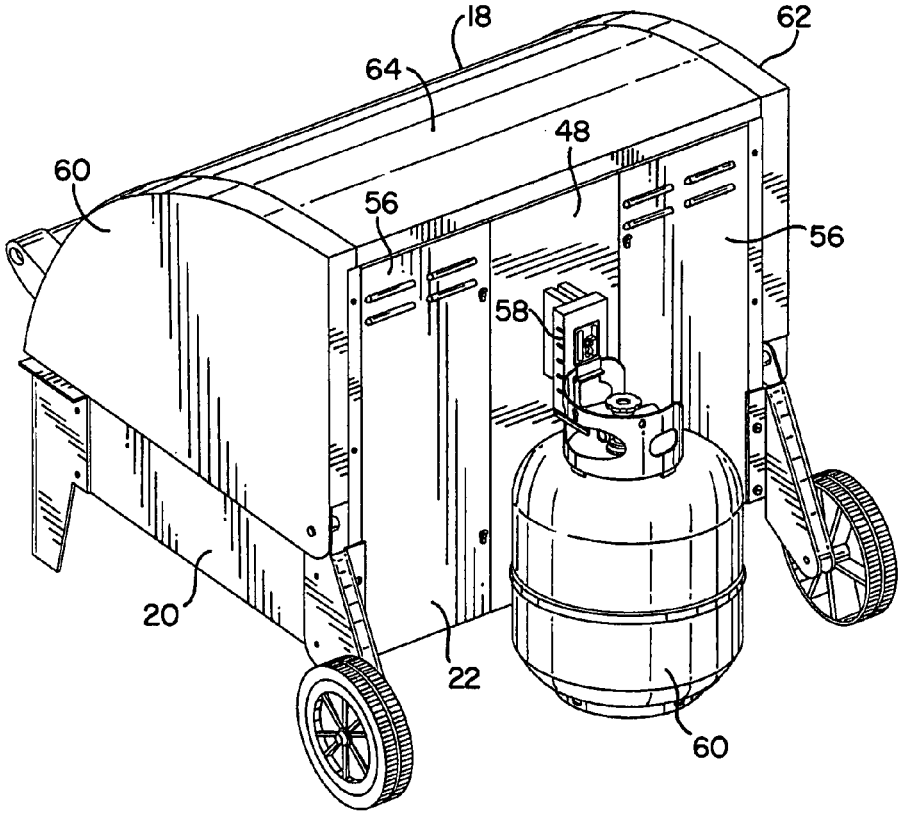
FIG. 3 is a perspective view of the rear of the outdoor fireplace of FIG. 1.

The rear member 48 of the second housing member 22 has a plurality of bent lips that increase the rigidity of the rear member 48 and allow the rear member 48 to operate as a bracket. As shown in FIG. 3, the rear member 48 supports a tank scale 58, which in turn supports a fuel tank 60 that provides fuel to the flame assemblies. In the preferred embodiment, the supply of fuel for either or both of the flame assemblies 14, 16 is provided by fuel in the fuel tank 60. However, other supplies of fuel, including, but not limited to natural gas, may be provided without departing from the scope of the present invention.

Opposing access panels 56 are provided in the rear of the second housing member 22 to provide access to the interior of the second housing member 22. The access panels 56 are located adjacent the rear member 48 and form a portion of the rear wall of the second housing member 22. The access panels 56 have a lip 57 which engages opposing first and second side members 50, 52, respectively. Additionally, the access panels 56 have a hole through which a threaded hand bolt can pass through to removably secure the access panels 56 to the rear member 48.

Figure 2:
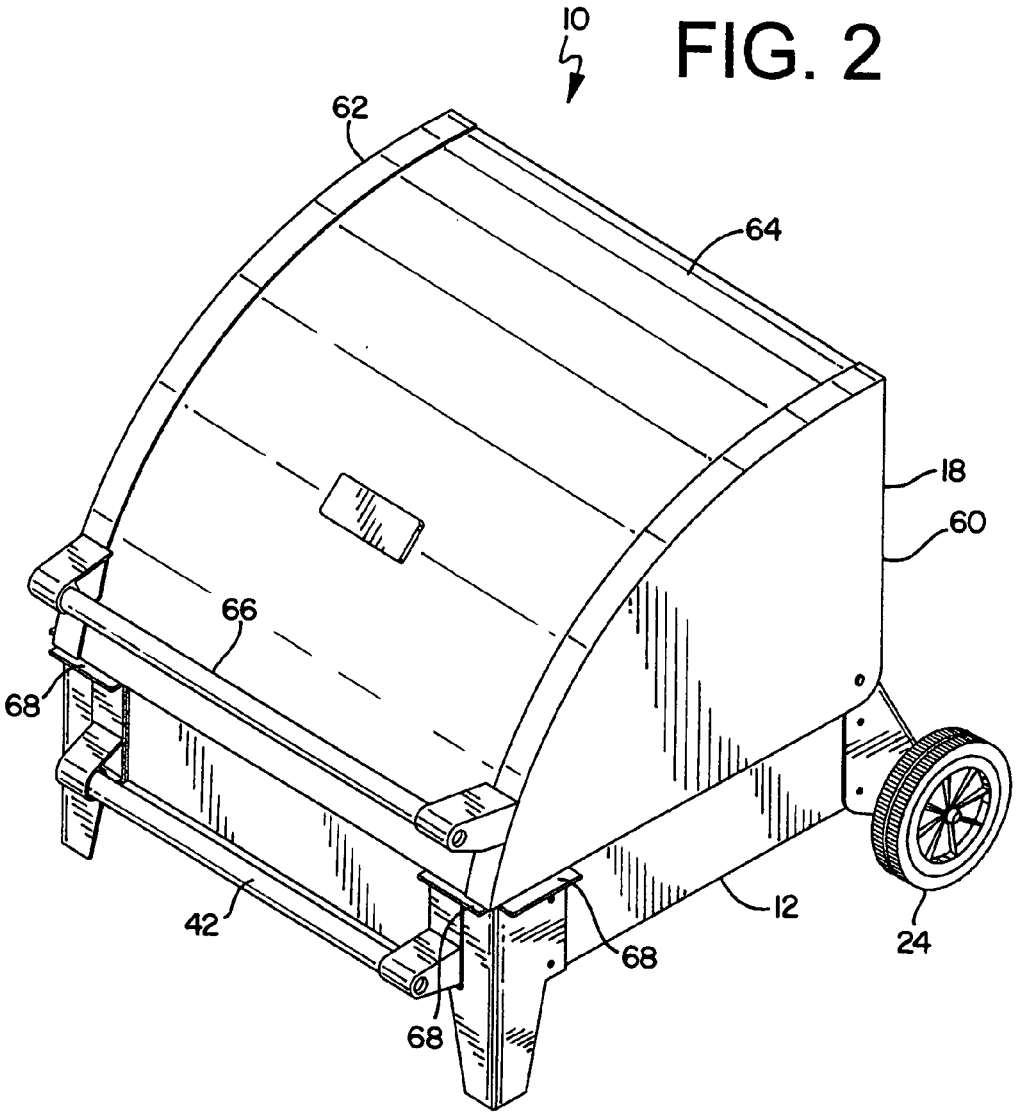
FIG. 2 is a perspective view of the outdoor fireplace of FIG. 1, with the hood closed.

As shown in FIGS. 1-3, the moveable hood 18 or lid depends from the fireplace housing 12 and is moveable between a first position (generally shown in FIG. 1) to a second position (generally shown in FIG. 2). The hood 18 is generally comprised of first and second end caps 60, 62 with a central member 64 therebetween. In a preferred embodiment, the first end cap 60 is rotatably secured to the first rear leg 38, and the second end cap 62 is rotatably secured to the second rear leg 40. The hood 18 also has a handle 66 for opening and closing the hood 18. The handle 66 is mounted at opposing ends to the first and second end caps 60, 62. As shown in FIG. 2, the first and second front legs 34, 36 have a ledge 68 on which the hood 18 rests when the hood 18 is in the second or closed position.

In one embodiment of the outdoor fireplace 10, the first flame assembly 14 provides an ornamental flame 70. The ornamental flame 70 provides the appearance of a wood-burning fire to the outdoor fireplace 10. The ornamental flame 70 may be provided by an artificial flame, such as a decorative flame comprising a fire-like rendition including a colored plastic, paper or any other type of apparatus that provides an artificial but realistic appearing flame, by a separate gas burner, by a carbon-burning element, or by any means which provides the appearance of a wood-burning fire. As such, the ornamental flame may or may not be comprised of a burning frame.

As shown in FIGS. 1 and 7, in a preferred embodiment the ornamental flame 70 of the first flame assembly 14 is provided by a flame from a first gas burner 72. In the preferred embodiment, the flame of the first gas burner 72 is provided by in a blue flame mode. Typically, blue flames release the majority of its energy through convention. The first gas burner 72 is generally mounted to the first housing member 20 of the fireplace housing 12. The first gas burner 72 in this embodiment has dispersing components 74, 76 thereon to disperse the gas flame, thereby providing the appearance of a wood-burning fire. In one embodiment, illustrated in partial cross-section in FIG. 7, the dispersing components include a plurality of lava rock 74 and a plurality of artificial logs 76, however it is not necessary to have both lava rock 74 and artificial logs 76. The use of either lava rack or artificial logs, or some other component capable of dispersing a flame, is acceptable. Generally, the lava rock 74 are disposed on the first gas burner 72, and the artificial logs 76 are disposed on the lava rock 74. In such a configuration, the artificial logs 76 are located on the lava rock 74 to further disperse the flame and to provide the appearance of a wood-burning fire.

One embodiment of the first gas burner 22 is illustrated in FIGS. 6 and 7. The first gas burner 72 comprises a burner plate 78 and a burner base 80. The burner base 80 is connected to the fireplace housing 12, and the burner plate 78 is mounted to a top of the burner base 80. Further, the burner base 80 has elevation members 82 which raise a surface 84 of the gas entrapment cavity 96 of the first burner 72 a distance above the bottom panel 26 of the first housing member 20 to allow a manifold 86 to pass underneath the first gas burner 72 and supply gas to the first burner 72. The elevation members 82 may be secured to the bottom panel 26 of the first housing member 20 to secure the first gas burner 22 in place. The burner base 80 further has a series of grate-like protrusions 88 adjacent a front of the burner base 80 to provide the appearance of a wood burning fireplace grate. Finally, a wall 90 depends from a rear of the burner base 80 to provide support for the dispersing components 74, 76.

The burner plate 78 comprises a member having a substantially planar surface 92, with shoulders 94 extending outwardly and downwardly therefrom. As such, when the burner plate 78 is positioned on the burner base 80, the substantially planar surface 92 of the burner plate 78 is praised off the burner base 80, thereby creating a cavity 96 between the burner plate 78 and the burner base 80. The burner plate 78 further has a plurality of apertures 98. Thus, fuel is supplied to the cavity 96 from the manifold 86, and as the fuel accumulates it fills the cavity 96 and is dispersed therefrom through the apertures 98 in the burner plate 78. Because of the heat generated, the burner plate 78 and burner base 80 of this embodiment are typically manufactured of stainless steel.

Another embodiment of the first gas burner 72*a* is illustrated in FIG. 8. In this embodiment, a burner plate 78 is not utilized. Instead, at least one burner tube 79 having a plurality of apertures 98 is utilized with a modified burner base 80. Further, in the embodiment illustrated, three burner tubes 79 are incorporated into the design. The burner tubes 79 are positioned directly above the upper surface 84 of the burner base 80. In such a configuration, the burner base 80 may be manufactured of a material other than stainless steel. The burner tubes 79 are secured at one end to the burner base 80, and at the other end to a manifold 86*a*. The manifold 86*a* is then connected in fluid communication with the first control valve 102. Tabs 83*a* depending from the burner base 80 assist in locating and securing the burner 72, including the burner tubes 79 and manifold 86*a*, in place. Additionally, dispersing components (not shown), such as lava rock and artificial logs are placed over the burner tubes 79 to disperse the gas flame, thereby providing the appearance of a wood-burning fire.

Yet another embodiment of the first gas burner 72*b* is illustrated in FIG. 9. Similar to the embodiment of FIG. 8, in this embodiment, a burner plate 78 is not utilized. Rather, at least one burner tube 79 having a plurality of apertures is utilized with a modified burner base 80*b*. Further, in the embodiment illustrated, three burner tubes 79 connected to a manifold 86*a* are incorporated into the design. The burner tube 79 and manifold 86*a* assembly in this embodiment may be identical to the burner tube 79 and manifold 86*a* assembly disclosed above. Unlike the above embodiment, the burner tubes 79 of the embodiment in FIG. 9 are positioned directly below the upper surface 84 of the burner base 80*b*. In such a configuration, the burner base 80*b* has a plurality of apertures 81 that mate with the apertures 98 of the burner tubes 79, and the burner base 80*b* may be similarly manufactured of a material other than stainless steel. The burner tubes 79 are secured at one end to the burner base 80*b*, and at the other end to the manifold 86*b*. The manifold 86*b* is then connected in fluid communication with the first control valve 102. Tabs 83*b* depending from the burner base 80 assist in locating and securing the burner 72, including the burner tubes 79 and manifold 86*b*, in place beneath the upper surface 84 of the burner base 80*b*. Additionally, dispersing components (not shown), such as lava rock and artificial logs are placed over the burner tubes 79 to disperse the gas flame, thereby providing the appearance of a wood-burning fire.

The second frame assembly 16, as shown in FIGS. 1 and 4, generally comprises a second burner 100 connected to the fireplace housing 12. In one embodiment, the second burner 100 is mounted to the transverse member 22. Both the first gas burner 72 and the second burner 100 are in fluid communication with the fuel supply.

Typically, the second burner 100 is a distinct type of burner from the first burner 72. In a preferred embodiment, the first burner 72 produces energy within a first range of wavelengths of the electromagnetic spectrum, and the second burner 100 produces energy within a second range of wavelengths of the electromagnetic spectrum. Moreover, the second wavelength range produced by the second burner 100 has a potion thereof which is outside that of the first wavelength range. Additionally, based on the configuration of the fireplace housing 12, the first gas burner 72 emits its energy in generally a first direction, and the second gas burner 100 emits its energy in a second direction which is transverse to the first direction of emitted energy from the first gas burner 72.

In a preferred embodiment, the second burner 100 is an infrared gas burner. Infrared heat energy, a form of radiation, produced by the infrared gas burner 100 is transferred via electromagnetic energy through space by means of electromagnetic waves (i.e., light waves that include visible and invisible waves). As such, the radiant heat from the infrared burner 100 is a form of energy that heats objects directly through a conversion process without having to heat the air in between. More specifically, the infrared burner 100 produces energy within the segment of the electromagnetic spectrum that falls between visible light and radar, and it is divided into 3 segments by wavelength: (1) the first segment is the near or close segment and the wavelengths are in the range of 0.076 microns to 1.5 microns; (2) the second segment is the middle or intermediate segment and the wavelengths are in the range of 1.5 microns to 5.6 microns; and, (3) the third segment is the far or long-wave segment and the wavelengths are in the range of 5.6 microns to 1,000 microns. Thus, as one of ordinary skill in the art understands, the infrared burner 100 does not radiate "heat," rather an infrared burner 100 radiates a certain wavelength of electromagnetic waves that strikes an object, thereby exciting the surface molecules of the object and causing them to vibrate. The heat generated by the increase of the motion of the surface molecules spreads to the interior of the object through conduction, resulting in the solid heating up.

The infrared gas burner 100 of this embodiment utilizes natural gas or liquid petroleum gas as the gas for combustion. In the preferred embodiment, the infrared gas burner 100 utilizes the combustion heat to heat a ported ceramic surface 106, however, other surfaces such as most perforated steel or certain wire meshes as are known in the industry may also be utilized. This ported surface 106 then releases a proportion of the infrared heat energy as explained above. Conversely, gas burners such as that found in the preferred embodiment of the first gas burner 72, produce blue flames which hover above the surface and release the majority of the energy through convection and not radiation. Further, while it is understood by those having ordinary skill in the art that infrared gas burners produce both infrared radiant heat and convective heat, infrared burners deliver a higher percentage of radiant heat and a lower percentage convective heat than blue flame gas burners.

In a preferred embodiment, a blue flame operating first gas burner 72 operates at about 45,000 to 55,000 BTU's, and the infrared second gas burner 100 operates at about 10,000 to 20,000 BTU's. As such, the total BTU's for the fireplace 10 when both burners 72,100 are operating is approximately 55,000 to 75,000 BTU's. At this operating range, the outdoor fireplace 10 should have a running time of approximately 5 to 6 hours on a single propane tank.

Figure 10:
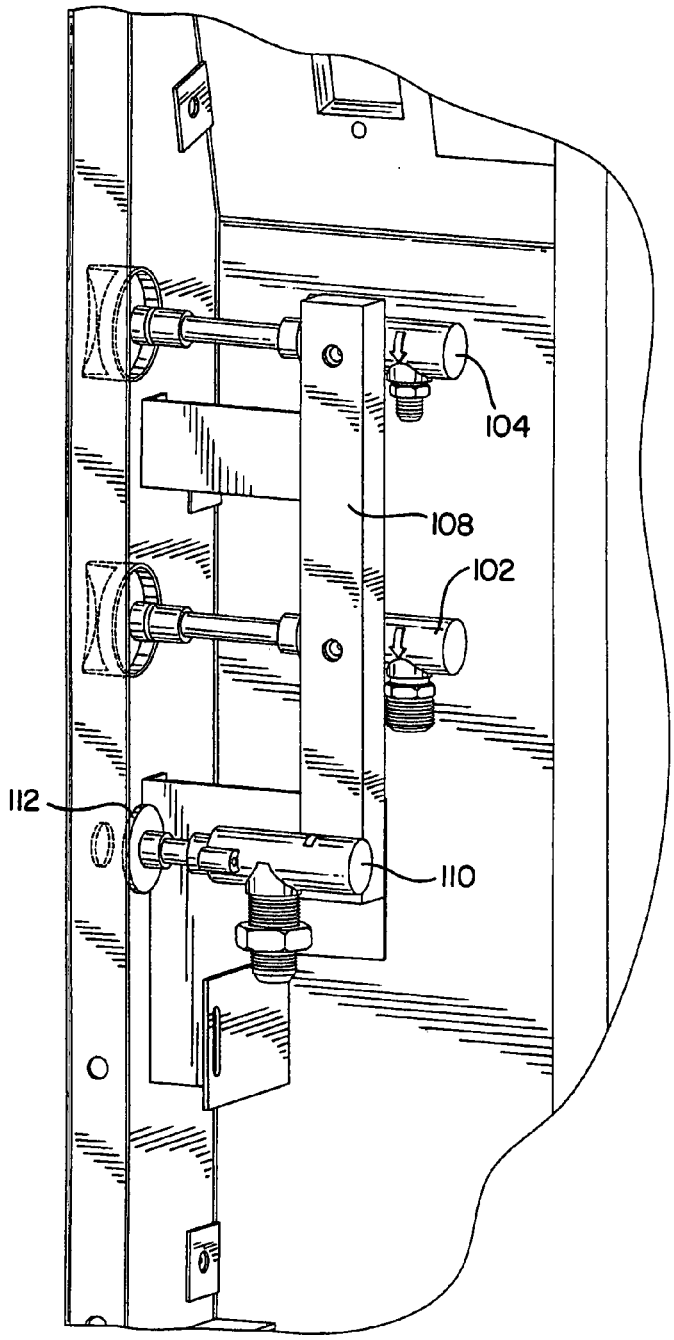
FIG. 10 is a partial perspective view of the manifold assembly of the outdoor fireplace of FIG. 1.

Valves control the flow of fuel to the first and second burners 72, 100. As shown in FIG. 10, in the preferred embodiment, there are separate control valves 102, 104 for each of the first and second burners 72, 100 respectively. The first control valve 102 is in fluid communication with the first burner 72 and controls the flow of fuel to the first burner 72, and the second control valve 104 is in fluid communication with the second burner 100 and controls the flow of fuel to the second burner 100. The first and second control valves 102, 104 are fluidly connected to the main manifold 108. The main manifold 108 is secured to an inside of the second housing member 22, and is accessible though removal of the access panel 63. Fuel from the gas supply 60 flows to the main manifold 108 through the gas shut off valve 110.

The control valves 102, 104 are operated via control knobs 103, 105 on the outside of the fireplace housing 20. The control knobs 103, 105 independently control the flow of fuel to the gas burners 72, 100, to independently control the heat dispersed from each burner, respectively. Additionally, each burner 72, 100 has an independent ignitor 107, 109 for igniting the respective burners.

Figure 11:
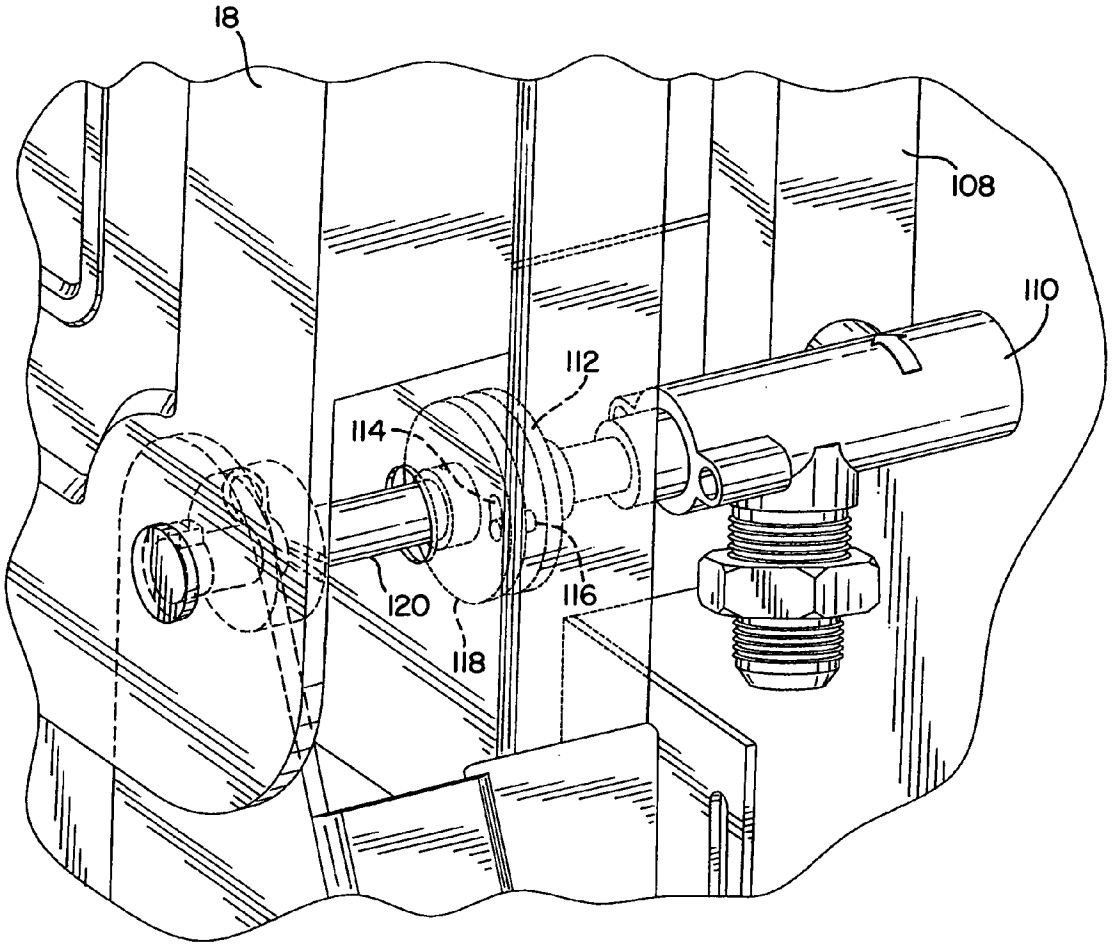
FIG. 11 is an enlarged perspective view of the gas shut off assembly illustrated in FIG. 10.

As shown in FIGS. 10 and 11, the gas shut off valve 110 for the outdoor fireplace 10 is connected to the main manifold 108. The gas shut off valve 110 is provided to ensure that fuel is shut off to the burners of the fireplace 10 when the lid of the fireplace is closed. The gas shut off valve 110 is manipulated by opening and closing of the hood 18. In one embodiment, the gas shut off valve 110 comprises a rotatable disk 112 which rotates to open and close the gas shut off valve 110. The rotatable disk 112 has slots 114 which engage pins 116 on a disk 118 connected to the rotating shaft 120 supporting the hood 18. Further, the rotating shaft 120 that supports the poop 18 is fixedly secured to the hood 18. As such, when the hood 18 is moved from the first position to the second position (i.e., when the hood is opened and closed), the shaft 120 rotates, and the pins 116 on the shaft 120 engage the disk 112, thereby manipulating the gas shut off valve 110. A sensor (not shown) may also be employed to sense the position of the hood and thereby manipulate opening and shutting of the gas shut off valve accordingly. Nevertheless, it is understood by one of ordinary skill in the art that numerous processes for manipulating the gas shut off valve are possible without departing from the scope of the invention.

Another embodiment of a gas outdoor fireplace 1010 is shown in FIGS. 12-19. This embodiment of the gas outdoor fireplace 1010 generally has a fireplace housing 1012, a burner assembly 1014 depending from the fireplace housing 1012, a plurality of panels 1016 removably covering the burner assembly 1014, a plurality of legs 1036 and a plurality of transport members 1024. In one example of this embodiment of the gas outdoor fireplace 1010, the outdoor fireplace 1010 receives its fuel from a fuel tank 1019 which is enclosed by a tank enclosure 1021, and in another example of this embodiment of the fireplace 1010 the fireplace 1010 receives its fuel from a dedicated fuel line. As is understood by those having ordinary skill in the art, the fuel for the fireplace 1010 is typically natural gas or liquid petroleum, however other fuels may be utilized without departing from the scope of the present invention.

As shown in FIGS. 12-15, a portion of the fireplace housing 1012 generally comprises a housing structure 1013. In one embodiment, the housing structure 1013 comprises a bottom member 1026 and a plurality of side members 1028, however, the housing structure 1013 may comprise only the side members 1028, only the base member 1026 or a combination of components. Further, separate components are not necessary. The bottom member 1026 and side members 1028 are typically made of steel, however they may be manufactured of other materials without departing from the scope of the present invention. A plurality of legs 1036 generally extend from the housing structure 1013. As explained in detail below, the side members 1028 have a panel receiving flange member 1027 depending from the top of the side members 1028 to assist in removably supporting the side panels 1016 of the outdoor fireplace 1010.

In a preferred embodiment, the side members 1028 at the various locations on the fireplace housing 1012 are substantially identical components, and thus are interchangeable. Similarly, the legs 1036 are substantially identical components, and thus are also interchangeable. The side members 1028 are connected with fasteners to the bottom member 1026, and the legs 1036 are similarly connected with fasteners to both the side members 1028 and the bottom member 1026.

The bottom member 1026 of the fireplace housing 1012 has a plurality of apertures therein. A first aperture 1029 in the bottom member 1026 of the fireplace housing 1012 provides access for a fuel supply line 1086 to extend from a control valve 1102 to the burner assembly 1014. A second aperture 1031 in the bottom member 1026 of the fireplace housing 1012 provides access for an ignitor 1107 for igniting the gas/air mixture expelled from the burner assembly 1014.

Figure 12:
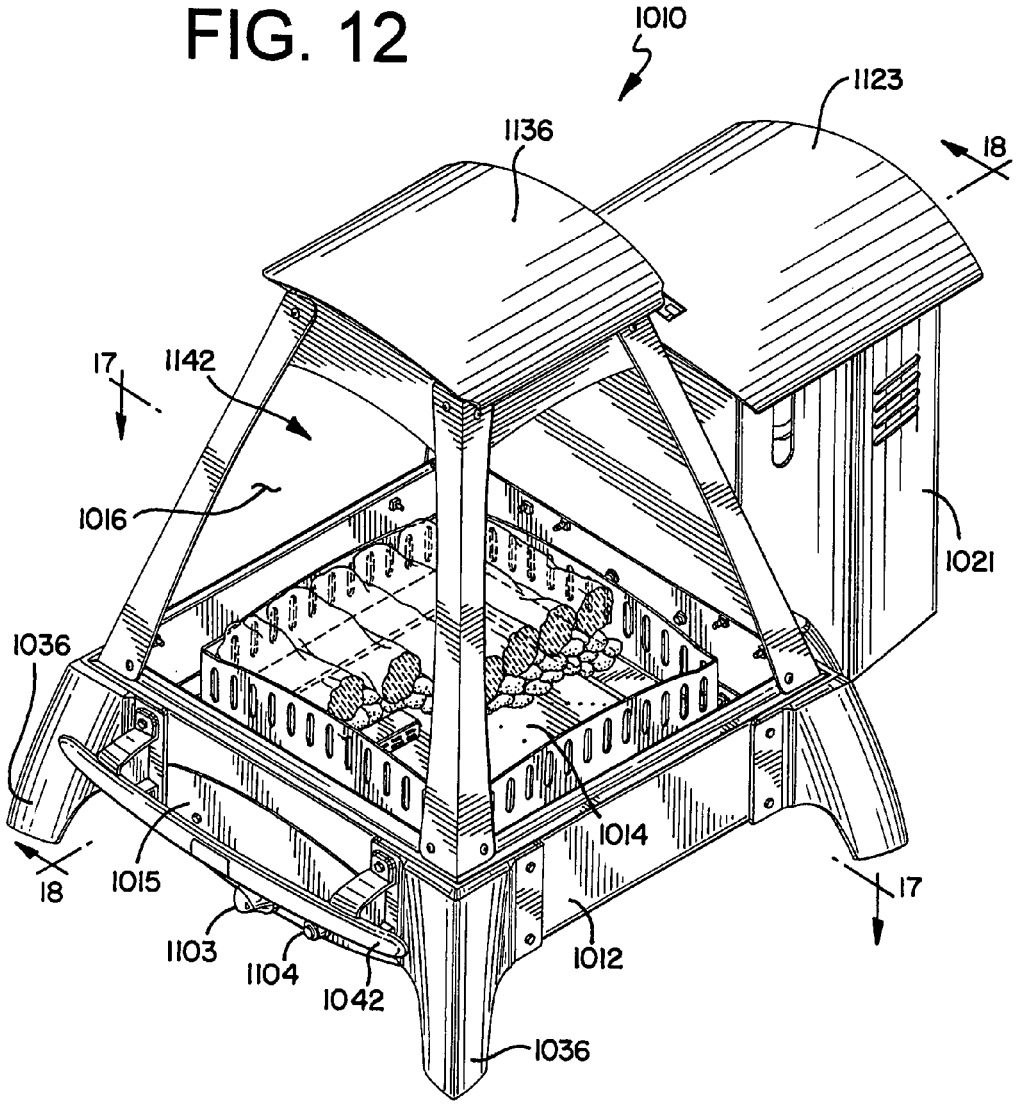
FIG. 12 is a front perspective view of another embodiment of the outdoor fireplace in a first position.
Figure 19:
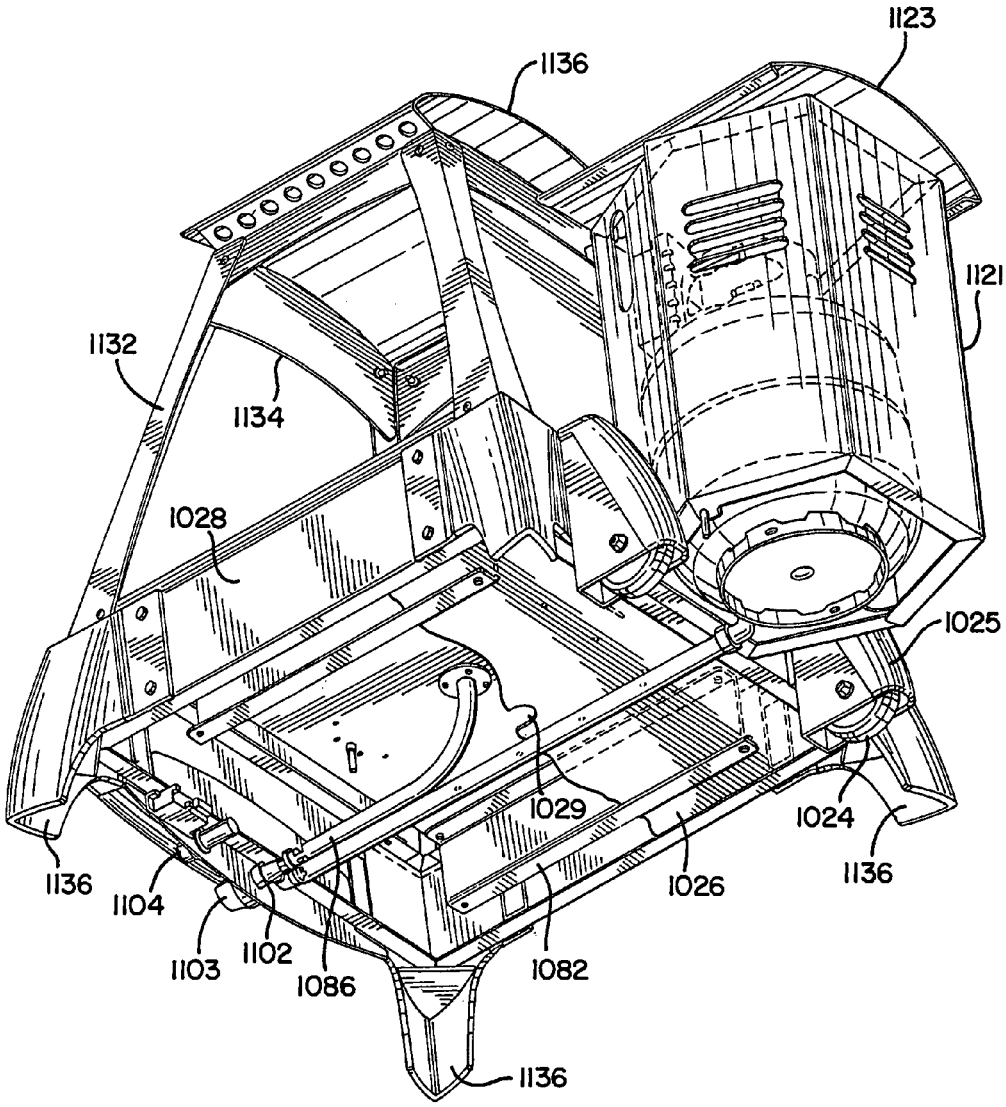

As shown in FIGS. 12 and 19, a control knob 1103 depends from a portion of the control valve 1102 located at the front of the fireplace housing 1102. The control knob 1103 adjusts the control valve 1102 to control the flow of fuel to the gas burner assembly 1014. Similarly, an ignitor controller 1104 extends from the front side member 1028 of the fireplace housing 1012. By depressing the ignitor controller 1104 a spark is provided at the ignitor 1107 to ignite the air/fuel mixture being expelled from the gas burner assembly 1014. A control panel 1015 between these components and the housing structure 1013 may also be provided as shown in the preferred embodiment.

A handle 1042 is connected to the fireplace housing 1012. In a preferred embodiment, the handle 1042 connects directly to the legs 1036 of the fireplace housing 1012. As shown in FIGS. 12-19 and explained in greater detail herein, one handle 1042 is provided to assist the user in moving the outdoor fireplace 1010. However, additional handles 1042 may be provided and connected to the legs 1036 around the fireplace housing 1012 in a similar fashion. As such, the handles 1042 may also be utilized as footrests for users situated around the outdoor fireplace 1010.

As best shown in FIGS. 15-18, the burner assembly 1014 generally comprises a gas burner 1072. The gas burner 1072 is connected to the fireplace housing 1012, and the burner 1072 is further in fluid communication with a supply of fuel to provide a flame for the outdoor fireplace 1010. The gas burner 1072 generally comprises a burner plate 1078 connected to a burner base member 1080, and a substantially enclosed cavity 1096 between the burner base member 1080 and the burner plate 1078. In a preferred embodiment, the burner plate 1078 is connected to a top surface of the burner base member 1080. Further, in a most preferred embodiment, the burner plate 1078 has a substantially planar surface 1092 with a plurality of apertures 1098 therein. In such an embodiment, the substantially planar surface 1092 is generally parallel to the burner base member 1080.

To assist in providing an appropriate volume for the substantially enclosed cavity 1096 between the burner base member 1080 and the burner plate 1078, the burner plate 1078 has a series of extensions extending from the surface 1092 of the burner plate 1078. The extensions generally comprise burner shoulders 1094 and burner flanges 1095. The burner shoulders 1094 extend generally downwardly from the surface 1092 of the burner plate 1078, and the burner flanges 1095 extend generally outwardly from the burner shoulders 1094. The burner flanges 1095 are typically secured to the burner base member 1080. The height of the burner shoulders 1094 generally assists in providing the appropriate height for the cavity 1096 of the burner 1072. As such, when the burner plate 1078 is positioned on the burner base 1080, the surface 1092 of the burner plate 1078 is raised off the burner base 1080 to create the cavity 1096 between the burner plate 1078 and the burner base 1080. Fuel is supplied to the cavity 1096 from the manifold 1086, and as the fuel accumulates it fills the cavity 1096 and is dispersed therefrom through the apertures 1098 in the burner plate 1078. Additional types of burners 1072 may be utilized as previously described herein.

In the embodiment illustrated in the FIGS. 12-19, the burner assembly 1014 is raised from the bottom member 1026 of the housing structure 1013 by a pair of burner brackets or elevation members 1082. Specifically, in the example illustrated in FIGS. 15, 16 and 19, a pair of elevation brackets 1082 are secured adjacent one end thereof to the bottom member 1026 of the fireplace housing structure 1013, and to another end thereof to the burner base member 1080 to elevate the gas burner 1072 from the bottom member 1026 of the housing structure 1013 and to secure the gas burner 1072 in place.

In a preferred embodiment, the burner base member 1080 has a plurality of transverse walls 1090 depending therefrom. The transverse walls 1090 have a plurality of openings 1091 therein to provide the appearance of a wood-burning fireplace grate. The transverse walls 1090 also assist in maintaining the dispersing members 1074, 1076 in a desired location. As explained above, in a preferred embodiment, the dispersing members 1074 generally comprise a plurality of lava rock, and the dispersing members 1076 generally comprise a plurality of artificial logs. Generally, the lava rock 1074 are disposed on the gas burner 1072, and the artificial logs 1076 are disposed on the lava rock 1074. In such a configuration, the artificial logs 1076 are located on the lava rock 1074 to further disperse the flame extending from the apertures 1098 in the burner plate 1078 and to provide the appearance of a wood-burning fire.

Figure 13:
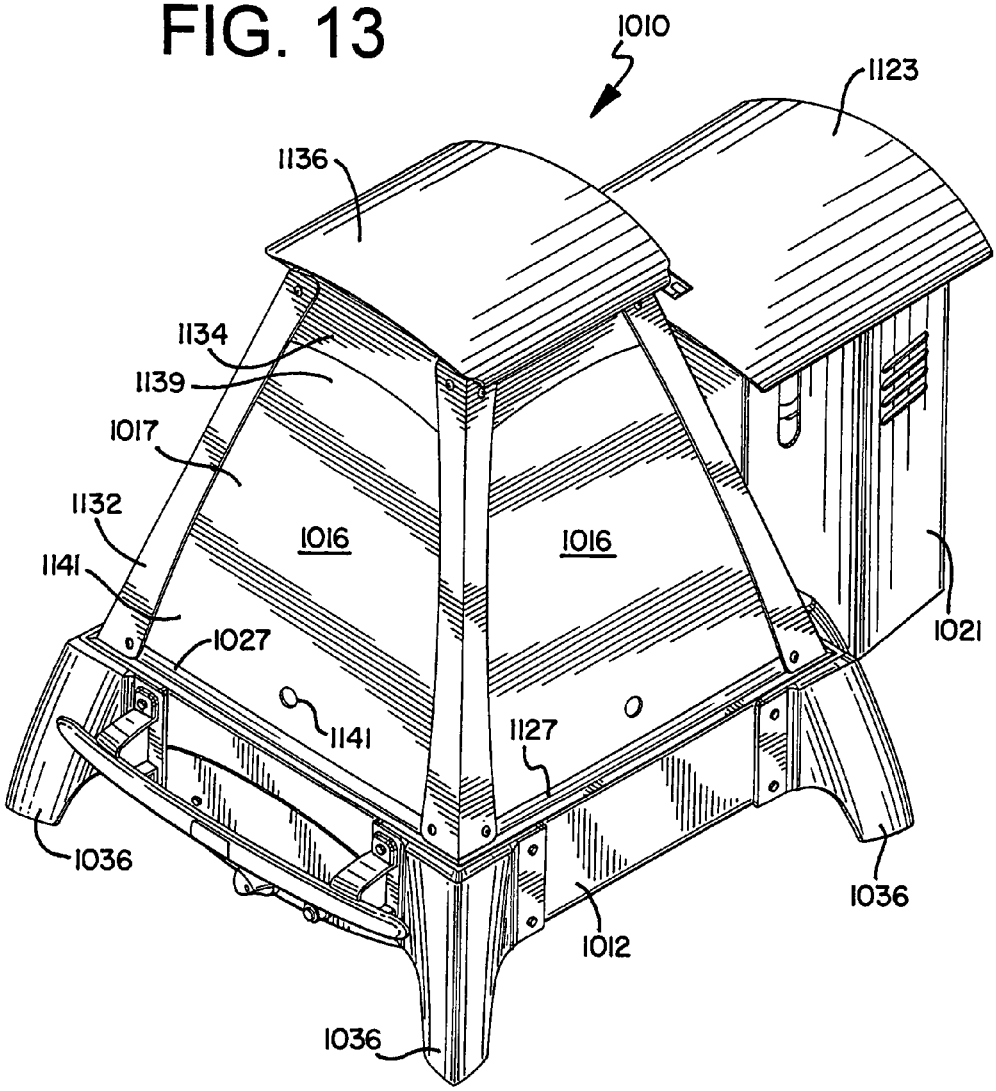
FIG. 13 is a front perspective view of the outdoor fireplace of FIG. 12 in a second position.
Figure 15:
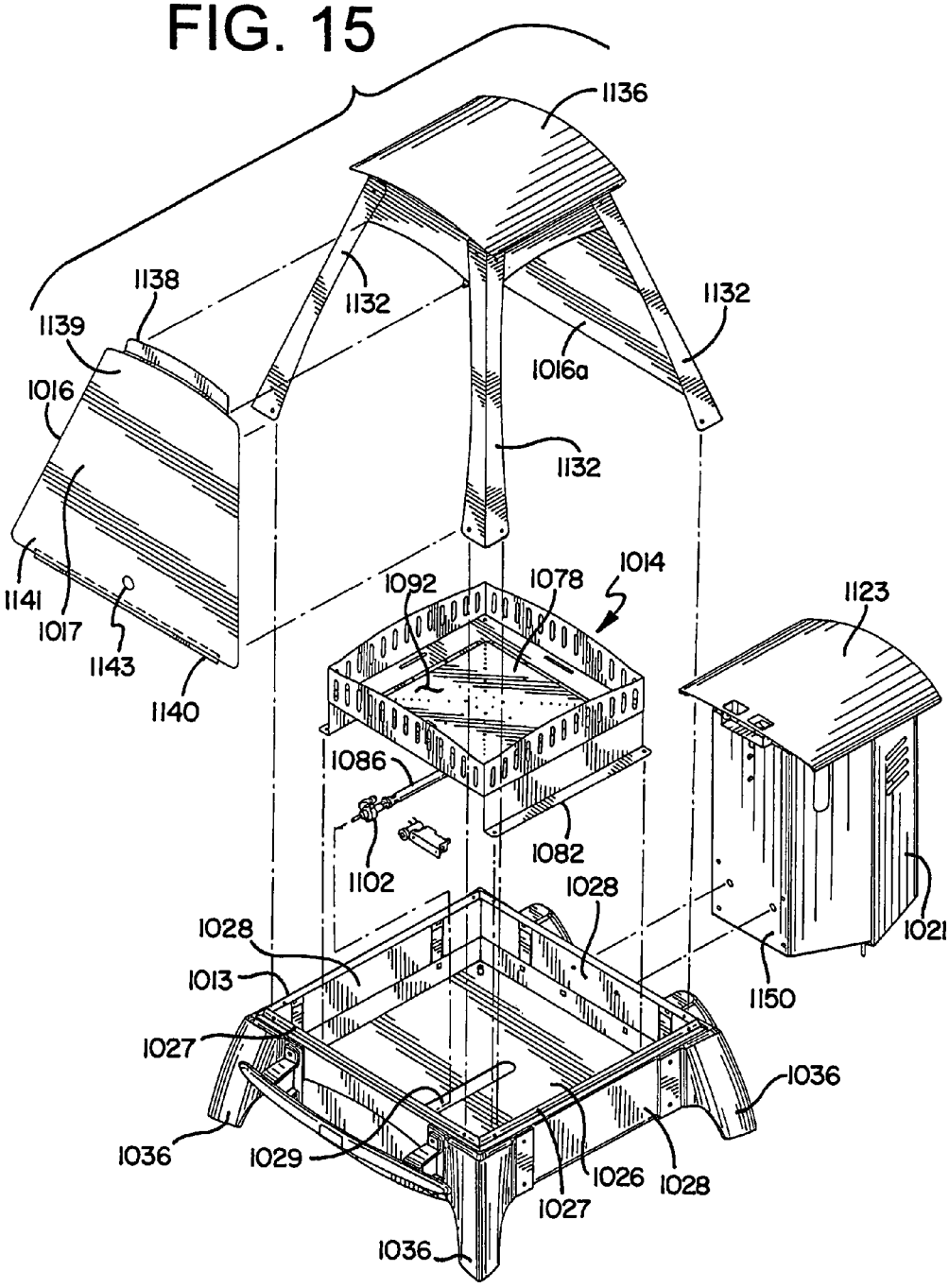
FIG. 15 is an exploded perspective view of the outdoor fireplace of FIG. 12.
Figure 16:
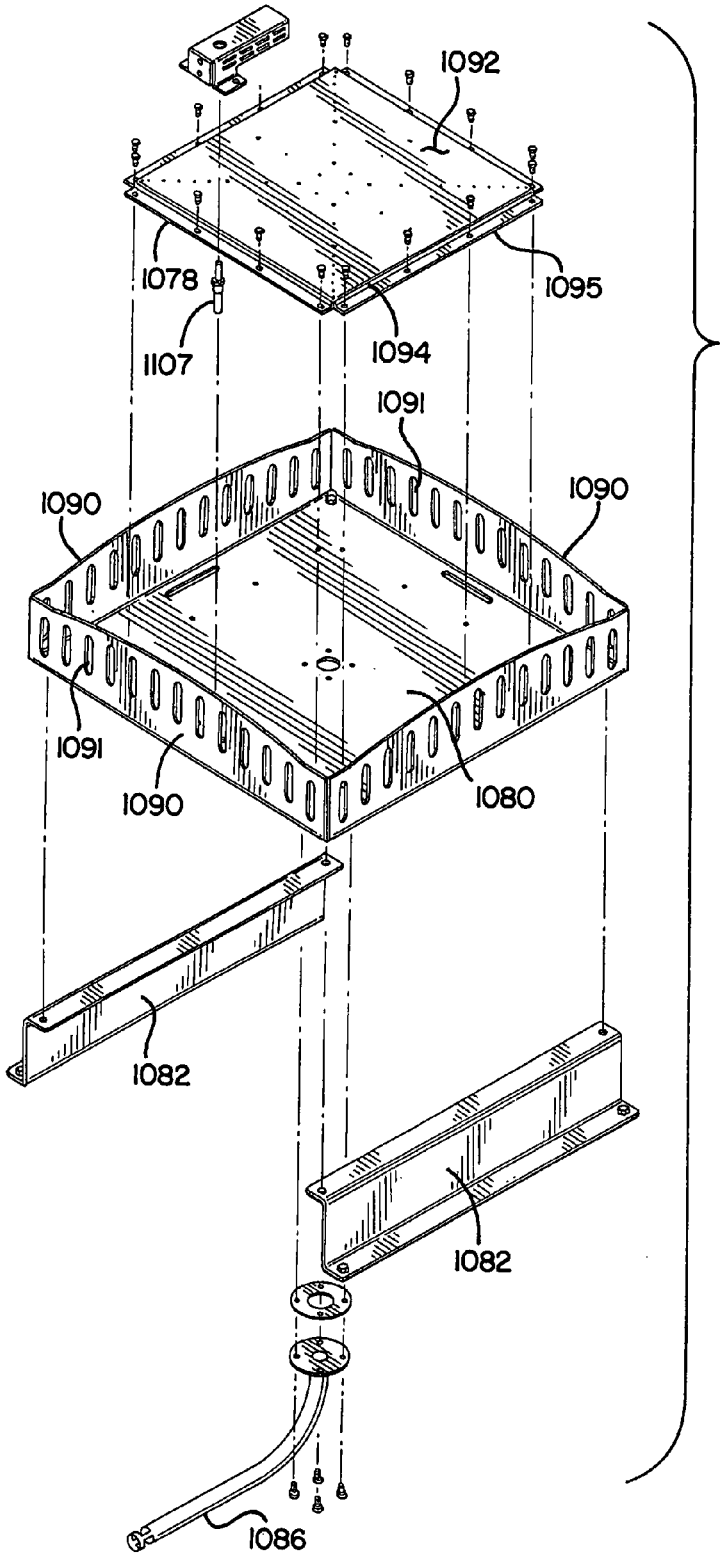
FIG. 16 is an exploded perspective view of an assembly of the outdoor fireplace of FIG. 12.
Figure 18:
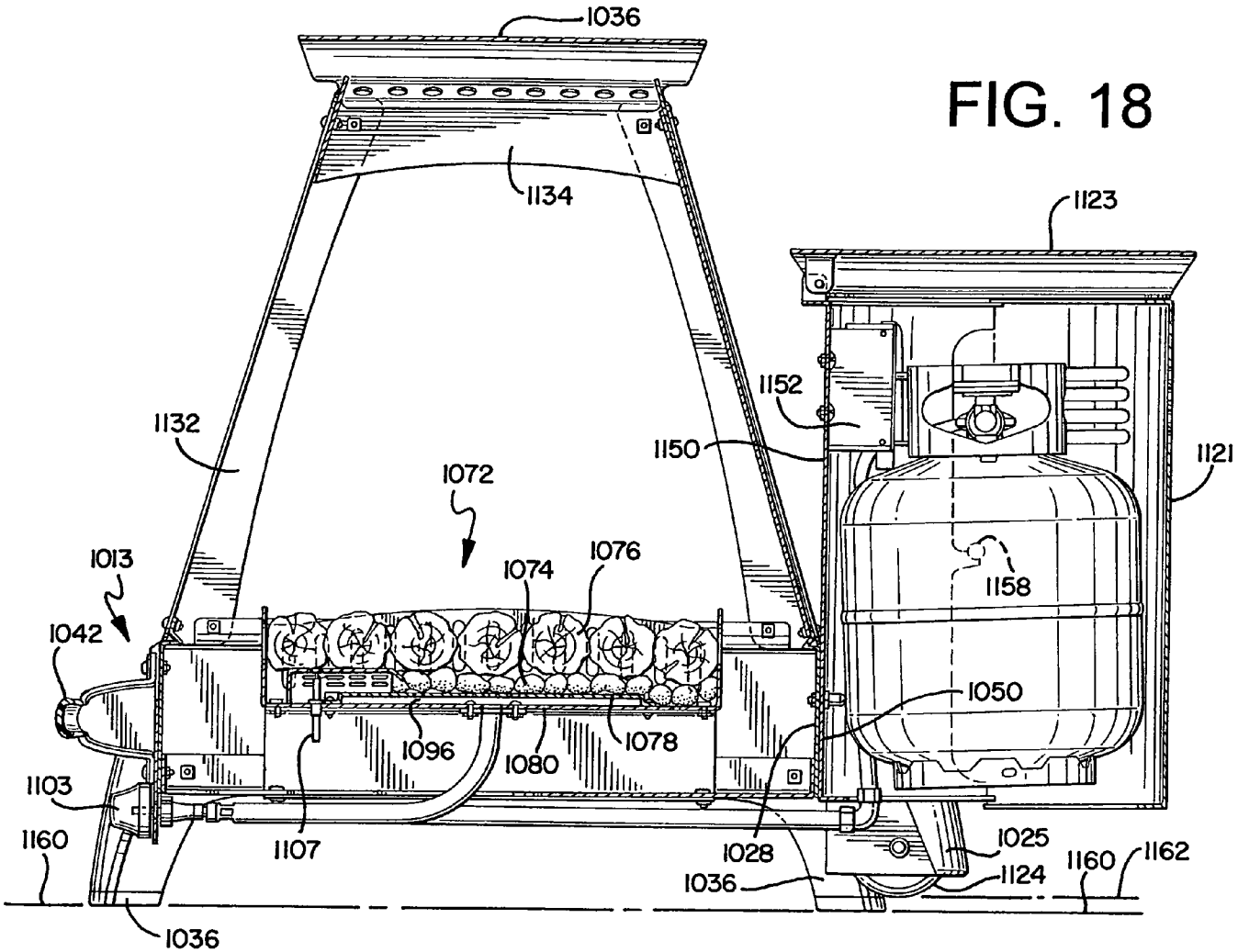
FIG. 18 is a cross-sectional view of the outdoor fireplace of FIG. 12 about line 18-18; and, FIG. 19 is a bottom perspective view of the outdoor fireplace of FIG. 12.

As explained above, and as shown in the figures, the outdoor fireplace 1010 has a plurality of side panels 1016 removable covering the burner assembly 1014. The side panels 1016 are removably secured to a panel support structure 1130. As best shown in FIGS. 12, 13 and 15, the side panel support structure 1130 generally comprises a plurality of panel supports 1132 extending from the housing structure 1013, and a plurality of braces 1134. More specifically, the panels supports 1132 are connected with fasteners at a first end to the housing structure 1013, and preferably to adjacent side members 1028 of the housing structure 1013. And, a second end of the panel supports 1132 is connected with fasteners to the braces 1134 as shown in FIG. 15. A hood 1136 is located on a top of the panel support structure 1130. The hood 1136 has a generally arcuate shape, and is connected to the braces 1134. Further, as shown in FIGS. 18 and 19, the hood 1136 has a plurality of vent holes.

As best shown in figures, the panels 1016 have a first panel flange 1138 depending from a first end 1139 of the panel body 1017, and a second panel flange 1140 depending from a second end 1141 of the panel body 1017. The panels 1016 also have a grasping member 1143, which is typically an aperture 1143 in the panel body 1017. In a preferred embodiment, the panels 1016 are individually removably connected to the outdoor fireplace 1010 in a sliding engagement with the fireplace housing. More specifically, the geometrical association of the first panel flange 1138 with the brace 1134 at the first end 1139 of the panel 1016, the geometric association of the second panel flange 1140 with the panel receiving flange member 1027 depending from the top of the side members 1028 at the second end 1143 of the panel 1016, and the geometry of the panel body 1017, allows the panels 1016 to be independently removed from the outdoor fireplace 1010 without fasteners, and assists in allowing an operator to independently remove panels 1016 from the outdoor fireplace 1010 without any tools.

To remove a panel 1016 from the outdoor fireplace 1010, a user first grasps the grasping member 1143 to manipulate the panel 1016 as it rests in the first position. Next, the operator slides the panel 1016 upward along the slope of the panel supports 1132 toward the panel brace 1134. When a first end 1139 of the panel body 1017 is generally adjacent the brace member 1134 (i.e., the second position) the second panel flange 1140 is in a position to become disengaged from the panel receiving flange member 1027 depending from the top of the side members 1028. The operator thus slightly pulls the second end 1141 of the panel 1016 outward from the panel support structure 1130 and the second panel flange 1140 becomes disengaged from the panel support structure 1130. The operator then can slide the panel 1016 downward to allow the first panel flange 1138 to become disengaged from the brace 1134 at the first end 1139 of the panel 1016. In this manner each panel 1016 can be independently removed from the outdoor fireplace 1010.

To insert a panel 1016 in the panel support structure 1130 of the outdoor fireplace 1010 a reverse procedure is followed. Specifically, the first panel flange 1038 is inserted toward a cavity 1142 of the outdoor fireplace 1010 (i.e., and under brace member 1134) and is slid upward. Further, a portion of the panel body 1017 rests on the panel supports 1132 to prevent the panels 1016 from collapsing into the cavity 1142 of the outdoor fireplace 1010. This is generally referred to as the second position. Next, the second panel flange 1040 is inserted toward the cavity 1142 of the outdoor fireplace 1010 and under the panel receiving flange member 1027 depending from the top of the side member 1028. The panel 1016 can then be slid downward such that the second end 1141 of the panel body 1017 rests on the top of the respective side member 1028. This is generally referred to as the first position. In this manner the panels 1016 can be removably inserted into the outdoor fireplace without fasteners and without the use of any tools.

Figure 14:
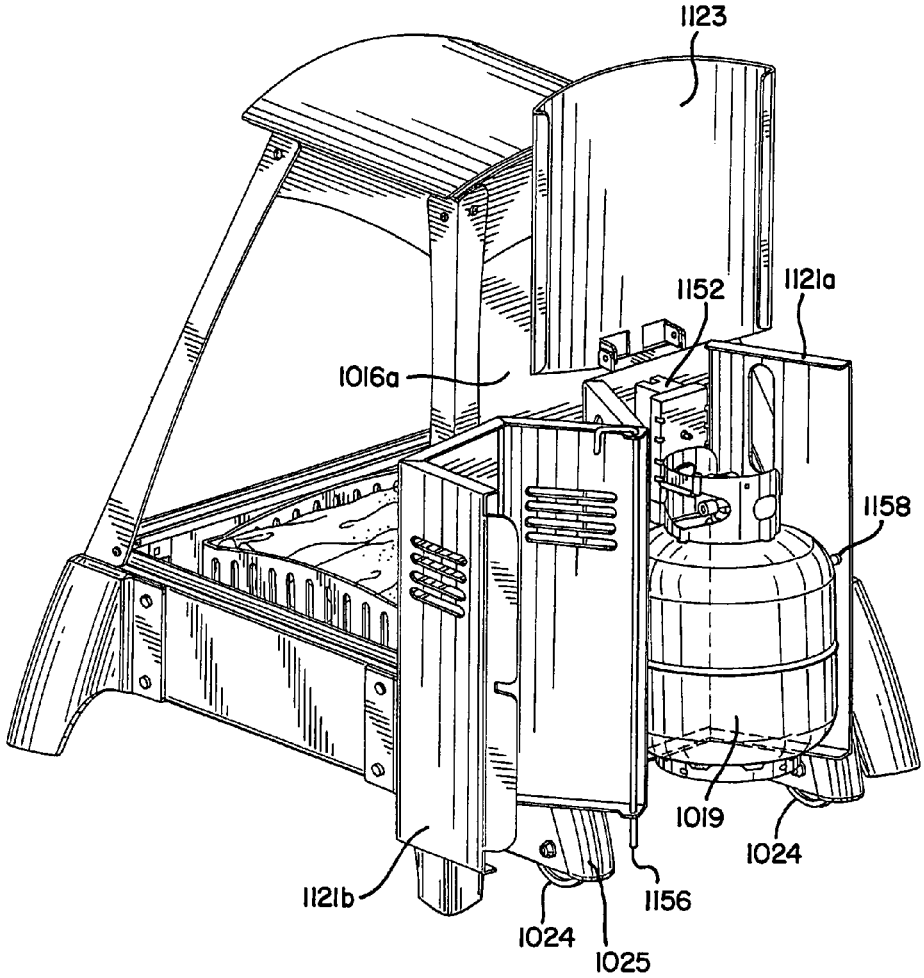
FIG. 14 is a rear perspective view of the outdoor fireplace of FIG. 12.

As shown in the figures, the outdoor fireplace 1010 has four sides, and thus four panel members 1016. In a preferred embodiment, the panel members 1016 are made of a stainless steel. The panel members 1016 typically shield the burner 1072, and more specifically shield any flame extending from the burner 1072 from the outside. Accordingly, by selectively removing the panels 1016 from the outdoor fireplace 1010, as shown in FIGS. 12 and 14, the operator can control the exposure of the environment to the flame from the outdoor fireplace 1010, and thus how the heat from the outdoor fireplace 1010 is distributed about the body of the outdoor fireplace 1010. In one embodiment where a fuel tank is utilized the panel member 1016 adjacent the tank enclosure 1021 is typically fixed to the panel support structure 1130, also as shown in FIGS. 12 and 14. All of the other panels, however, are removable. Conversely, in an embodiment wherein a direct fuel line is utilized and no tank enclosure 1021 is required, each of the panels 1016 are individually removable from the outdoor fireplace 1010. When the outdoor fireplace 1010 is not being utilized, each of the side panels 1016 are typically connected to the outdoor fireplace 1010 as shown in FIG. 13, generally for storage purposes.

As shown in FIGS. 18 and 19, a tank support 1150 is provided to removably support the fuel tank 1019. The tank support 1150 is connected to the fireplace housing 1012. As explained above, the tank support 1150 is preferably provided adjacent a portion of the fireplace housing 1012 having a fixed side panel 1016. In a preferred embodiment, the tank support 1150 comprises a portion of the tank enclosure 1021. As shown in FIG. 18, a first member 1021*a* of the tank enclosure 1021 is connected adjacent one end thereof with fasteners to one of the side members 1028 of the housing structure 1013. Further, a tank scale 1152 is connected to the first member 1021*a* of the tank enclosure 1021 adjacent an opposing end of the first member 1021 of the tank enclosure 1021. The tank scale 1152 provides a dual feature of having the fuel tank 1019 removably connected thereto to support the fuel tank 1019, and also providing a scale to generally represent the amount of fuel remaining in the fuel tank 1019. For this purpose an aperture 1154 is provided in the tank enclosure 1021 to allow the operator to view the gauge on the tank scale 1152.

The tank enclosure 1021 of the preferred embodiment generally comprises a first member 1021*a*, a second member 1021*b*, and a tank enclosure hood 1123. The tank enclosure 1021 is typically positioned at a perimeter of the outdoor fireplace housing 1012. In an embodiment disclosed, the tank enclosure 1021 has a hexagon shape, with the first member 1021*a* comprising three of the hexagon walls, and the second member 1021*b* comprising another three of the hexagon walls. Further, similar to the hood 1136 of the fireplace housing 1012, the tank hood 1123 also has a generally arcuate shape. The tank hood 1123 is generally fixed in a hinged manner to the first member 1021*a* of the tank enclosure as shown in FIG. 18. This allows the tank hood 1123 to be rotated or hinged upward to open the tank enclosure 1021.

As explained above, the first member 1021*a* is generally fixed to the fireplace housing 1012. The second member 1021*b*, however, is generally moveable with respect to the first member 1021*a*. As shown in the figures, a pivot member 1156 is provided to join the first member 1021*a* with the second member 1021*b* at a first joint thereof to allow the second member 1021*b* of the tank enclosure 1021 to selectively rotate or hinge to provide access to for the fuel tank 1019 to be inserted into the tank enclosure 1021. A latch 1158, shown in FIG. 18, is provide at the second joint thereof between the first member 1021*a* and the second member 1021*b* of the tank enclosure 1021. Thus, to open the tank enclosure 1021, the tank hood 1123 is first rotated upward. Next, the second member 1021*b* is raised slightly, thereby releasing the second member 1021*b* from the first member 1021*a* at the latch 1158 thereof. Finally, the second tank enclosure member 1021*b* can be rotated or hinged outwardly at the pivot member 1156, thereby opening the tank enclosure 1021. A reverse procedure is followed to close an open tank enclosure 1021.

Figure 17:
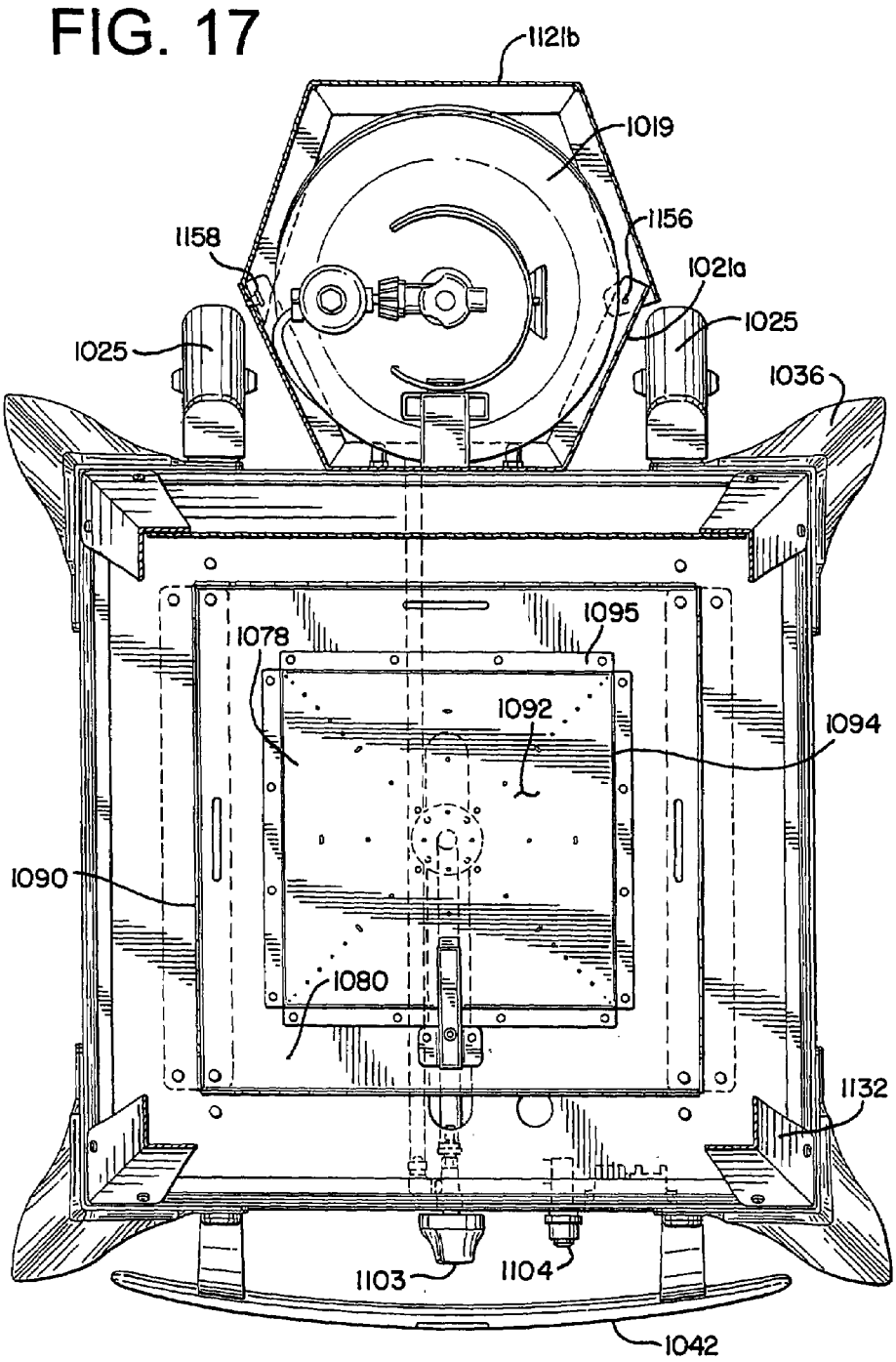
FIG. 17 is a cross-sectional view of the outdoor fireplace of FIG. 12 about line 17-17.

The outdoor fireplace 1010 of the preferred embodiment also has a plurality of transport members 1024. In a preferred embodiment, the transport members 1024 are wheels connected to the housing structure 1013 of the fireplace housing 1012. More specifically, as shown in FIGS. 17 and 18, wheel covers 1025 are connected to the fireplace housing 1012, and a shaft member connected to the wheel covers 1025 secures the wheels 1024. The wheels 1024 are connected at a position such that the wheels 1024 remain off the ground when each of the legs 1036 of the outdoor fireplace 1010 are situated on the ground. Specifically, as shown in FIG. 18, a baseline plane 1160 of the outdoor fireplace 1010 is provided and generally defined as the plane extending between the bottom of the legs 1036 of the outdoor fireplace 1010. Further, a wheel plane or transport plane 1162, generally defined as a plane tangential to the wheels 1024 and parallel to the baseline plane 1160, is also provided. The wheel plane 1162 is located a distance above the baseline plane 1160 of the outdoor fireplace 1010. Accordingly, when the outdoor fireplace 1010 is positioned on the ground, the wheels 1024 remain off the ground. However, when the handle 1042 connected to the front of the fireplace housing 1012 is raised to a certain height, the wheels 1024 will gain contact with the ground and the legs 1036 will lose contact with the ground. In this manner the outdoor fireplace 1010 can be transported about its wheels 1024.

It is also understood that the bottom of both the tank enclosure 1021 and the fuel tank 1019 are positioned a distance above the baseline plane 1160. Further, in the preferred embodiment, the bottom of the tank enclosure 1021 and the bottom of the fuel tank 1019 are positioned a distance above the wheel plane 1162 of the outdoor fireplace 1010. This allows the outdoor fireplace 1010 to be tilted upward by the handle 1042 and be moveable without having the tank enclosure 1021 or the fuel tank 1019 unnecessarily contacting the ground.

While the specific embodiments have been illustrated and described, numerous modifications come to mind without significantly departing from the spirit of the invention, and the scope of protection is only limited by the scope of the accompanying Claims.

What is claimed is:

1. A gas fueled outdoor fireplace, comprising:

a fireplace housing having a housing structure, at least one opening in at least one side, and a plurality of legs extending from the housing structure;

the side of the fireplace having a first lip near an upper edge of the opening and a second lip near a lower edge of the opening;

a burner connected to the fireplace housing, the burner in fluid communication with a supply of fuel to provide a flame;

a plurality of side panels connected to the housing, wherein at least one of the side panels is configured to cover the opening and is individually removable from the housing, without any other disassembly of the outdoor fireplace, to expose the burner.

the removable side panel having a first flange at an upper edge of the side panel and a second flange at a lower edge of the side panel;

the removable side panel being slidingly movable between a first position and a second position;

when the removable side panel is placed in the first position, the first flange engaging with the first lip and the second flame engaging with the second lip to prevent outwardly movement of the side panel and an inside surface of the removable side panel engaging with an outside surface of the side of the fireplace to prevent inwardly movement of the side panel; and, when the removable side panel is placed in the second position, the second flange being no longer engaged with the second lip whereby the removable side panel can be tilted outward from the lower edge.

2. The gas fueled outdoor fireplace of claim 1, wherein a plurality of the side panels are connected to the housing without fasteners.

3. The gas fueled outdoor fireplace of claim 1, wherein a plurality of the side panels are removable from the housing without tools.

4. The gas fueled outdoor fireplace of claim 1, wherein a plurality of the side panels are moveable from a first position to a second position, the side panels being connected to the housing in the first position and substantially shielding the burner from view in the first position, and the side panels being individually removable from the housing in the second position to expose the burner.

5. The gas fueled outdoor fireplace of claim 1, wherein one of the side panels is fixed to the housing.

6. The gas fueled outdoor fireplace of claim 1, further comprising a wheel for transporting the fireplace, the wheel being connected to the housing structure in a position that a wheel plane is a distance above a baseline of the outdoor fireplace.

7. The gas fueled outdoor fireplace of claim 1, further comprising a support connected to the fireplace housing for connecting a removable fuel tank thereto.

8. The gas fueled outdoor fireplace of claim 1, wherein the opening has a first dimension along an axis and the removable side panel has a second dimension along the axis which is greater than the first dimension.

9. The gas fueled outdoor fireplace of claim 7, wherein when the fuel tank is connected to the support a bottom of the fuel tank is positioned a distance above a baseline of the outdoor fireplace.

10. The gas fueled outdoor fireplace of claim 1, further comprising a tank enclosure connected to the outdoor fireplace housing, and positioned at a perimeter of the outdoor fireplace housing.

11. The gas fueled outdoor fireplace of claim 10, wherein the enclosure has a hinged door to provided access to the fuel tank.

12. The gas fueled outdoor fireplace of claim 1, further comprising a hinged hood over the tank enclosure.

13. The gas fueled outdoor fireplace of claim 1, wherein the burner comprises a burner plate adjacent a burner base member, and a substantially enclosed cavity between the burner base member and the burner plate, the burner plate having a plurality of apertures therein, and wherein the fuel enters the substantially enclosed cavity between the burner base member and the burner plate and is dispersed through the apertures in the burner plate.

14. The gas fueled outdoor fireplace of claim 1, further comprising a first handle connected to the fireplace housing.

15. The gas fueled outdoor fireplace of claim 14, wherein the handle is connected to a portion of the housing structure of the fireplace housing opposing a fuel supply for the outdoor fireplace.

16. The gas fueled outdoor fireplace of claim 1, further comprising a plurality of handles connected to the housing structure of the fireplace housing.

* * * * *